US007201083B2

(12) United States Patent
Bader et al.

(10) Patent No.: US 7,201,083 B2
(45) Date of Patent: Apr. 10, 2007

(54) DEPTH STOP DEVICE

(75) Inventors: Thomas Bader, Landsberg (DE); Matthias Keith, Buchloe (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/285,551

(22) Filed: Nov. 21, 2005

(65) Prior Publication Data

US 2006/0107797 A1 May 25, 2006

(30) Foreign Application Priority Data

Nov. 25, 2004 (DE) ..... 10 2004 056 855

(51) Int. Cl.
*B25B 21/00* (2006.01)
*B25B 23/02* (2006.01)

(52) U.S. Cl. ..... 81/54; 81/429

(58) Field of Classification Search ..... 81/54, 81/429, 180.1
See application file for complete search history.

(56) References Cited

U.S. PATENT DOCUMENTS

| | | | | |
|---|---|---|---|---|
| 3,710,832 | A * | 1/1973 | Lafferty | 81/429 |
| 4,030,383 | A * | 6/1977 | Wagner | 81/54 |
| 4,762,035 | A * | 8/1988 | Fushiya et al. | 81/429 |
| 6,240,816 | B1 * | 6/2001 | Riedl et al. | 81/429 |
| 6,499,381 | B2 * | 12/2002 | Ladish et al. | 81/429 |

* cited by examiner

*Primary Examiner*—David B. Thomas
(74) *Attorney, Agent, or Firm*—Abelman, Frayne & Schwab

(57) ABSTRACT

A depth stop device (14) for use with a hand-held screw driving tool (2) includes an axial element (32) for driving a screw bit (34) and a sleeve element (20) having a longitudinal bore (30) in which the axial element (32) is at least partially received and an exit opening (36) extending sidewise from the longitudinal bore (30). The exit opening (36) is limited by a deflection surface (40) which is stretched over an intersection plane (SE) and has a geometrical center (M) that forms an origin of a spatial system of coordinates. The intersection plane (SE) forms with a tangential axis (T) of the spatial coordinate system that extends perpendicular to both the longitudinal (L) and radial (R) axis of the coordinate system, an acute angle (α).

9 Claims, 4 Drawing Sheets

DEPTH STOP DEVICE

BACKGROUND OF THE INVENTION

1. Field of the Invention

The present invention relates to a depth stop device for use with a hand-held screw driving tool, in particular with a screw driving tool for use in a dry construction works. The depth stop device includes an axial element for driving a screw bit of the screw driving tool, and a sleeve element having a longitudinal bore in which the axial element is at least partially received along an axis of the longitudinal bore. An exit opening extends sidewise from the longitudinal bore. The exit opening is limited by a deflection surface which is inclined relative to the longitudinal axis of the bore in a direction of a housing side of the sleeve element and has a deflection edge in the longitudinal bore. The deflection edge has a tip extending in a direction of a working tool side of the sleeve element.

2. Description of the Prior Art

Depth stop devices of the type described above are used in order to be able to initially adjust a desired drive-in depth for a fastening element to provide for a uniform press-on force applied by sealing washers to a fastening element, e.g., in case of withering of the attachment point. A typical use of a depth stop device is an attachment of gypsum plaster plates, chip plaster plates, or fiber plates to a framework. Screwing takes place often without preliminary forming a bore. In particular, at an overhead work, material particles, which are released during a screw-in process, penetrate in the longitudinal bore of the sleeve element. In order to prevent penetration of the released material particles into the interior of the screw driving tool, appropriate seals should be provided on the screw driving tool. However, in many cases, the use of seals leads to power losses, and the seals are subjected to high wear. Alternatively, or in addition to seals, there is provided, in the depth stops, means for removing the material particles from the sleeve element. Thereby accumulation of gypsum in front of seals is prevented so that the costs associated with the seals, can be reduced.

U.S. Pat. No. 3,710,832 discloses a depth stop of a screw driving tool in which a longitudinal bore of a sleeve-shaped stop is provided with four side openings. Each of the side openings is limited, in both tangential directions and at the screw-driving tool side, by an inclined surface. With these surfaces, material particles which penetrate, during an operation, between the stop element and the bit holder of the screw driving tool, are shaved off the bit holder and are removed outwardly.

A drawback of the depth stop device of U.S. Pat. No. 3,710,832 consists in that the sleeve element has, because of a plurality of inclined surfaces, high manufacturing costs. Moreover, at overhead works, a relatively large amount of material particles accumulates on the deflection edges. A further drawback of this depth stop device consists in that with the known shape of the sleeve element, the working tool should be handled separately from the depth stop device to be able to carry out the necessary replacement of the working bit in the bit holder or to be able to remove an improperly set fastening element from a workpiece.

U.S. Pat. No. 6,240,816 discloses a sleeve element provided with somewhat keyhole-shaped openings. In these openings, a to-be-removed tool bit or a fastening element can be clamped or engage in to enable an easier removal of the tool bit or the fastening element from, respectively, the bit holder or a workpiece with the sleeve element.

An object of the present invention is to provide a depth stop device of the type discussed above in which the drawbacks of the known depth stop devices are eliminated.

A further object of the present invention is to provide a depth stop device that would insure an improved deflection of the material particles and a wide use of the depth stop device, while having reduced manufacturing costs.

SUMMARY OF THE INVENTION

These and other objects of the present invention, which will become apparent hereinafter, are achieved by providing a depth stop device of the type described in the preamble and in which the deflection surface is stretched over an intersection plane and has a geometrical center that forms an origin of a spatial system of coordinates. The spatial coordinate system has a longitudinal axis extending parallel to the longitudinal axis of the bore and a radial axis that intersects the longitudinal axis of the bore and extends perpendicular to the longitudinal axis. The intersection plane forms with a tangential axis of the spatial coordinate system and that extends perpendicular to both the longitudinal axis and the radial axis of the coordinate system, an acute angle.

In the inventive depth stop device, the intersection plane or the deflection surface is inclined not only to the longitudinal axis but also to the tangential axis. In this way, the deflection surface is inclined in the rotational direction of the axial element which is parallel to the tangential axis. The at least double inclination of the deflection surface insures that the deflection surface shaves material particles from the axial element and deflects them further in the axial direction for removing them out from the longitudinal bore of the sleeve element. This double function of the deflection surface insures a simple and cost-effective manufacturing of the depth stop device. The present invention insures that material, which is removed during the screw-in process, e.g., in form of gypsum particles, and which penetrates the longitudinal bore of the sleeve element at its working tool side, is particularly easily removed from the sleeve element.

According to a particular advantageous embodiment of the present invention, the acute angle is formed between the tangential axis and an intersection axis formed by intersection of the intersection plane and a plane defined by the tangential axis and the longitudinal axis of the spatial coordinate system. In addition, the deflection edge of the deflection surface is inclined in the rotational direction toward the working tool side of the sleeve element. This inclination of the deflection edge or the deflection surface relative to the axis of the sleeve element prevents the removable material particles, in particular at an overhead work, from remaining on the deflection edge and prevents their penetration, after the completion of the screw-in process, back into the longitudinal bore of the sleeve element and the interior of the screw driving tool. As a result, an expensive sealing of the screw driving tool can be eliminated, whereby the effectiveness of the tool increases and the manufacturing costs and wear of the tool are reduced.

Advantageously, the acute angle which is formed by the intersection plane and the tangential axis, amounts to from 30° to 60°. This angle insures a particular effective shaving of the removable material particles off the axial element and minimizes the quantity of material particles that remains on the deflection edge. An acute angle in a range from 40° to 50° proved to be particularly advantageous as with this angle, a relatively long extension of the deflection surface is provided, which again provides for a good deflection effect. At the same time, the necessary longitudinal extension of the exit opening remains relatively small. As a result, the exit opening can be formed in the sleeve element without any problems.

Advantageously, the intersection plane intersects a plane which is defined by the longitudinal and radial axes, along an intersection axis that forms with the longitudinal axis an angle from 30° to 40°.

Thereby, material particles, which are displaced in the axial direction, e.g., at an overhead work, can be particularly effectively removed from the longitudinal bore of the sleeve element.

Advantageously, the exit opening narrows in a direction toward the working tool side. As a result, the exit opening not only provides for an improved deflection of the material particles but also enables clamping and removal of a screw bit from a bit holder, which provides for a multiple use of the inventive depth stop device.

Advantageously, the exit opening is limited in a rotational tangential direction by two straight, radially extending side surfaces. This insures an easy and, thereby, cost-effective formation of the exit opening.

Advantageously, the sleeve element has two, located opposite each other, exit openings. This provides for an adequate stability of the sleeve element and insures, at the same time, a satisfactory deflection of the removable material particles.

It is further advantageous when a deflection flute is formed between the deflection surface and one of the two side surfaces. This provides for concentric exit of the material particles from the sleeve element.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
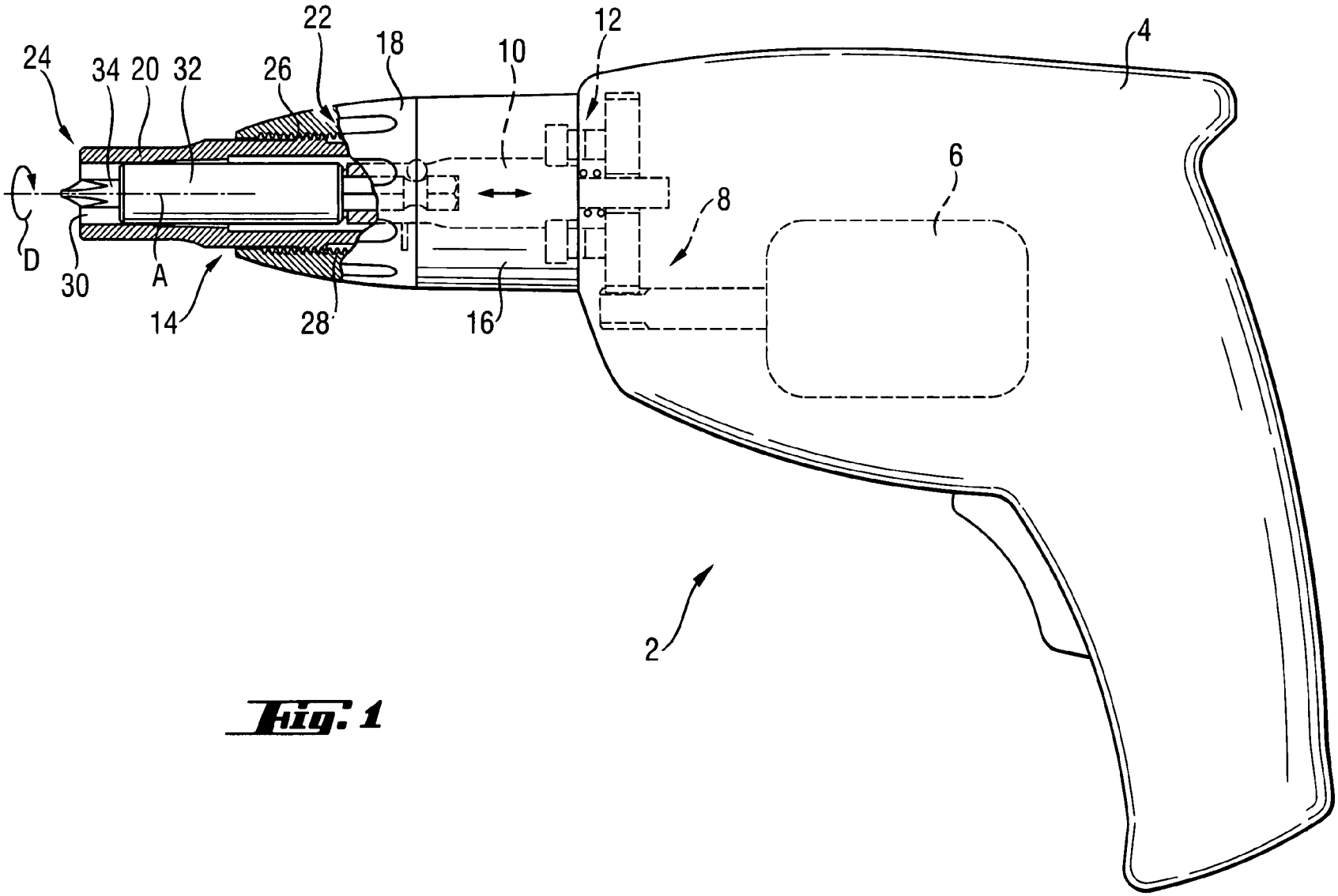
FIG. 1 a side view of a screw driving tool with depth stop device according to the present invention shown in cross-section.

FIG. 1 shows a screw driving tool 2 which is formed as a screw driving tool for use in dry construction works. The screw driving tool 2 includes a housing 4 in which there is arranged a motor 6 and a gear 8 for rotationally driving an axially displaceable tool spindle 10 with which the gear 8 is connected by a friction clutch 12. The screw driving tool 2 drives in a conventional screw, not shown, by rotating it in a clockwise direction D about an axis A.

At the driving tool end of the housing 4, there is arranged a depth stop device according to the present invention and designated generally with a reference numeral 14. The depth stop device 14 includes a connection sleeve 16 for releasable connecting the depth stop device 14 to the housing 4. The connection sleeve 16 supports an adjusting ring 18 and a sleeve element 20. At its housing side 22, the sleeve element 20 is provided with an outer thread 26 that engages in an inner thread 28 of the adjusting ring 18. The sleeve element 20 is axially adjustable relative to the connection sleeve 16 or the housing 4 by rotation of the adjusting ring 18.

The sleeve element 20 has a longitudinal bore 30 extending from its housing side 22 towards its working tool side 24. An axial element 32, which is form as a bit holder and is connected with the tool spindle 10 for joint rotation therewith, projects into the bore 30. A screw bit 34 is inserted into the axial element 32. Alternatively, the axial element 32 can be formed integrally with the tool spindle 10.

Figure 2:
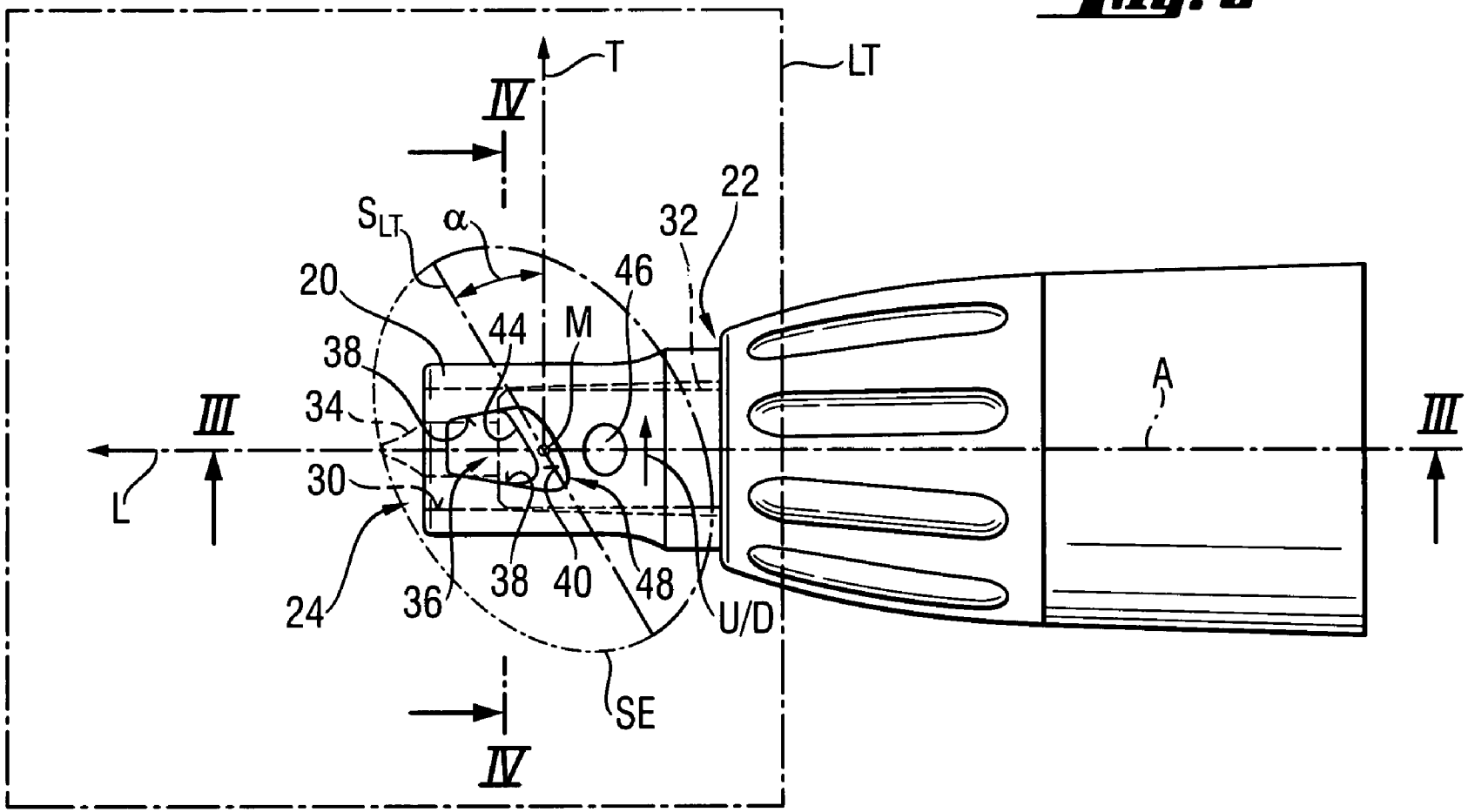
FIG. 2 a side view of the depth stop device shown in FIG. 1.

As shown in FIG. 2, the sleeve element 20 has two exit openings 36 located circumferentially opposite each other. The exit openings 36 are limited on opposite sides in a circumferential rotational and tangential direction U essentially by side surfaces 38, and toward the housing side 22 of the sleeve element 20 essentially by respective deflection surfaces 40.

The deflection surface 40 has a geometrical center M that forms an origin of a virtual spatial system of coordinates. The coordinate system has a longitudinal axis L that extends parallel to the longitudinal axis of the sleeve element 20 that coincides, in the mounted condition of the depth stop device 14, with the axis A of the screw driving tool 2.

Figure 3:
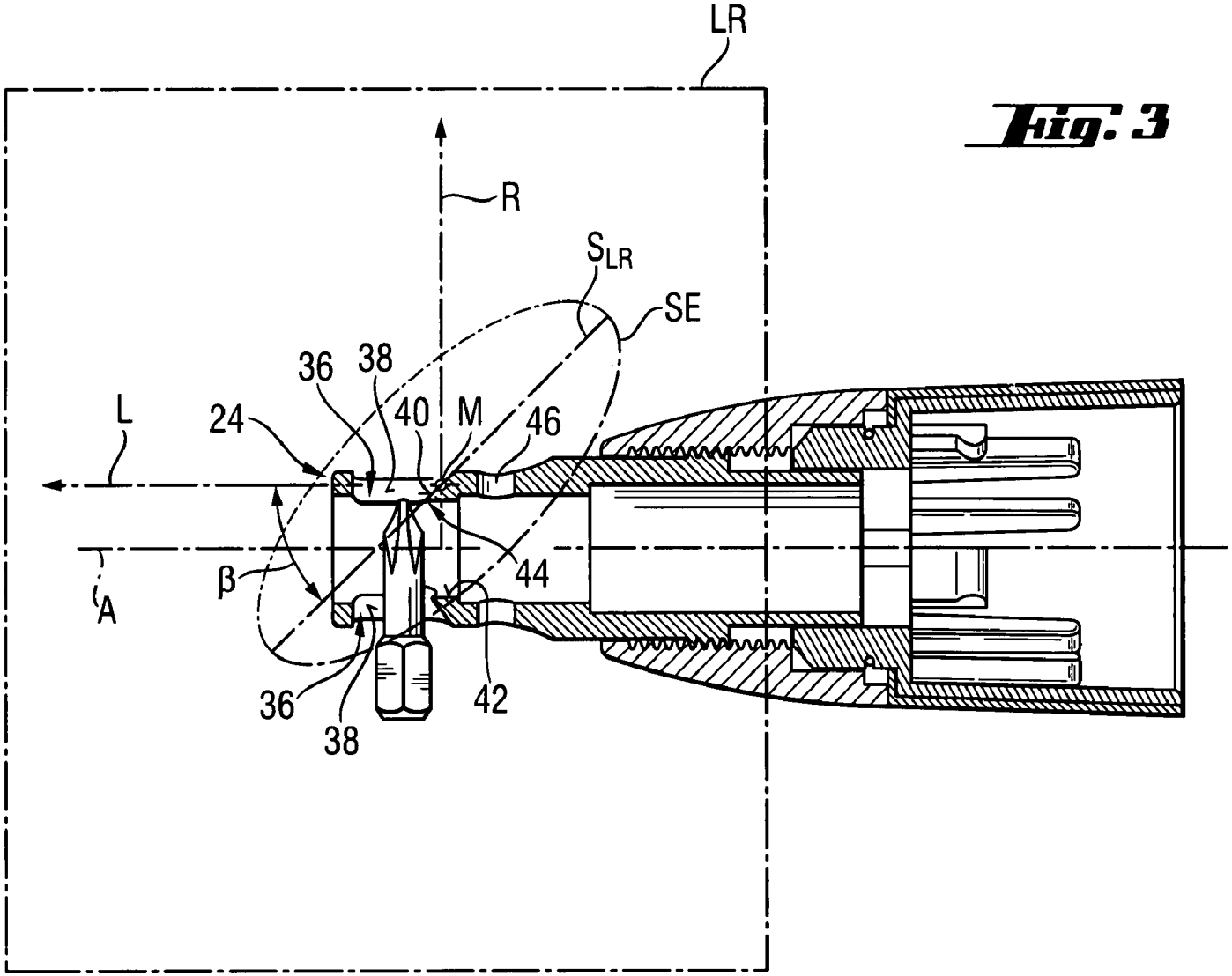
FIG. 3 a longitudinal cross-sectional view of the depth stop device along line III—III in FIG. 2 when used for removal of the tool bit.
Figure 4:
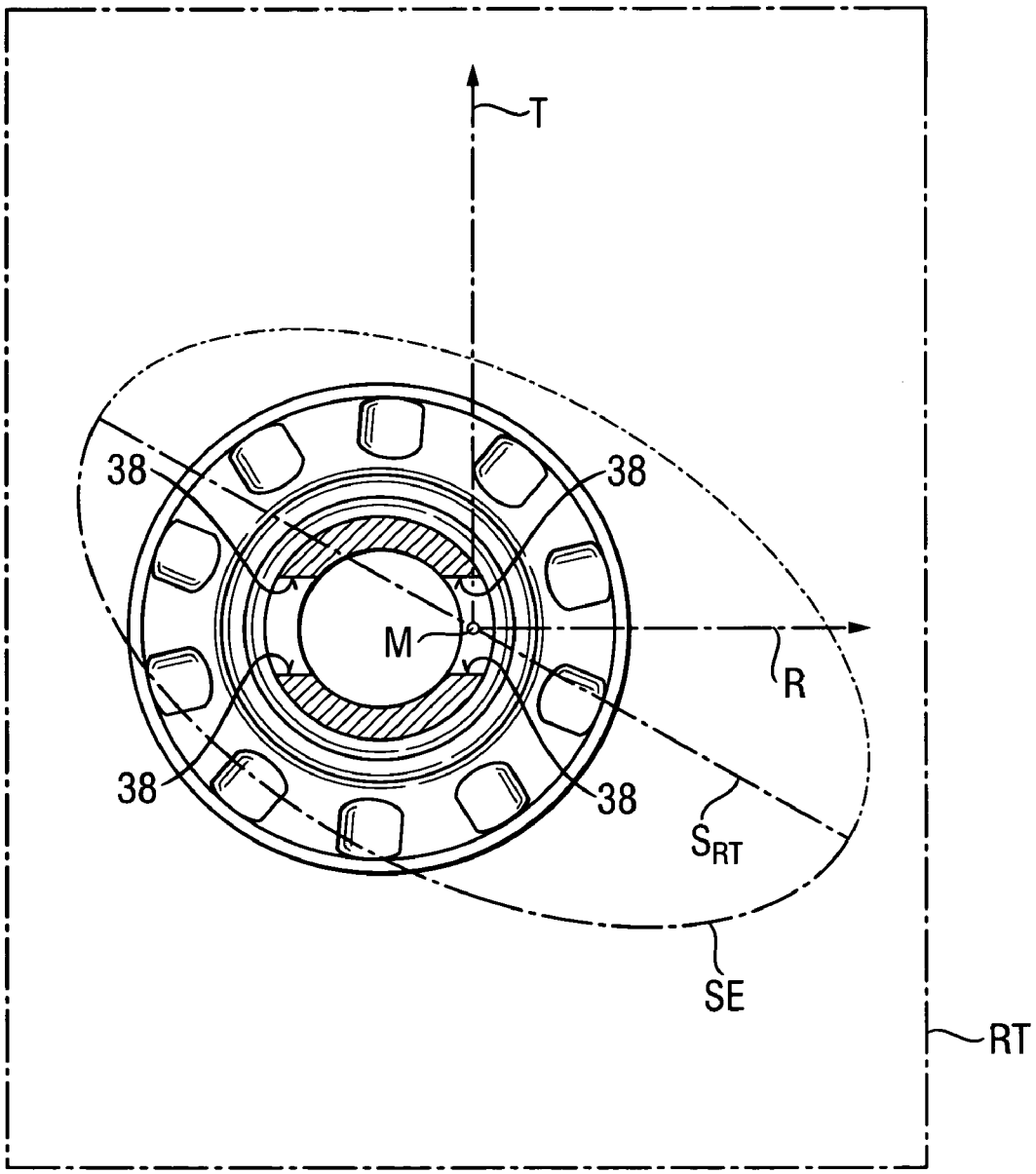
FIG. 4 a cross-sectional view of the sleeve element of the depth stop device along line IV—IV in FIG. 2.

The longitudinal axis L intersects, in the center M, a radial axis R that extends perpendicular to the axis A as shown in FIG. 3. The longitudinal axis L also intersects a tangential axis T that extends perpendicular to both the longitudinal axis L and the radial axis R, as shown in FIGS. 2 and 4.

As shown in FIG. 2, the deflection surface 40 stretches over an intersection plane SE that intersects, along an intersection SLT, a plane LT defined by the longitudinal axis L and the tangential axis T. The intersection axis SLT forms with the tangential axis T an angle $\alpha$ amounting from 40° to 50°.

As shown in FIG. 3, the intersection plane SE also intersects, along an intersection axis SLR, a plane LR defined by the longitudinal axis L and the radial axis R. The intersection axis SLR forms with the longitudinal axis L an angle $\beta$ amounting to from 30° to 45°.

In this way, the deflection surface 40 forms, together with a cylindrical wall 42 of the longitudinal bore 30, a deflection edge 44 the tip of which extends toward the working tool side 24 of the sleeve element 20. The deflection edge 44 is tilted, in the rotational direction D, toward the working tool side 24, as shown in FIG. 2.

The side surfaces 38 of the exit openings 36 are aligned parallel to the radial axis R that defines, together with the tangential axis T, a plane RT, as shown in FIG. 4. The side surfaces 36 reduce the distance therebetween toward the working tool side 24 of the sleeve element 20, as particularly show in FIG. 2.

When a screw is driven in a relatively porous material such as, e.g., chip plaster board or gypsum plaster board, material particles are released, in particular, at an overhead work, which penetrate in the longitudinal bore 30 and between the wall 42 and the axial element 32 at the working tool side 24. As a result of rotation of the axial element 32, the deflection edge 44 rubs off the axial element 32, deflecting the material particles from the axial element 22. The inclination of the deflection edge 44 in the rotational direction D provides for a good removal of the material particles over the deflection surface 40. The rounding of the transition between the deflection surface 40 and the rear, in the rotational direction D, side surface 38 provides, as shown in FIG. 2, for formation of deflection flute 48 that enables a concentric exit of the material particles.

The narrowing of the exit opening 36 in the direction toward the working tool side 24 of the sleeve element 20 permits to use the depth stop device 14, when it is not mounted on the screw driving tool 2, for removal of the screw bit 34 from the bit holder 32 or for pulling the incorrectly set fastening elements. As shown in FIG. 3, for removal of the screw bit 34, the bit 34 is clamped between the side surfaces 38 and is pulled out by pulling the depth stop device 14.

In order to be able to remove as different as possible types of screw bits 34, there are provided, in addition to exit openings 36, two receiving openings 46 which extend sidewise from the longitudinal bore 30.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A depth stop device (14) for use with a hand-held screw driving tool (2), comprising:

an axial element (32) for driving a screw bit (34) of the screw driving tool (2); and a sleeve element (20) having a longitudinal bore (30) in which the axial element (32) is at least partially received along an axis (A) of the longitudinal bore (30), and an exit opening (36) extending sidewise from the longitudinal bore (30);

wherein the exit opening (36) is limited by a deflection surface (40) which is inclined relative to the longitudinal axis (A) of the bore (30) in a direction of a housing side (22) of the sleeve element (20) and which has a deflection edge (44) at the longitudinal bore (30) and having a tip extending in a direction of a working tool side (24) of the sleeve element (20), wherein the deflection surface (40) is stretched over an intersection plane (SE) and has a geometrical center (M) that forms an origin of a spatial system of coordinates, wherein the spatial coordinate system has a longitudinal axis (L) extending parallel to the longitudinal axis (A) of the bore (30) and a radial axis(R) that intersects the longitudinal axis (A) of the bore (30) and extends perpendicular to the longitudinal axis (L), and wherein the intersection plane (SE) forms with a tangential axis (T) of the spatial coordinate system that extends perpendicular to both the longitudinal axis (L) and the radial axis (R) of the coordinate system, an acute angle ($\alpha$).

2. A depth stop device according to claim 1, wherein the acute angle ($\alpha$) is formed between the tangential axis (T) and an intersection axis (SLT) formed by intersection of the intersection plane (SE) and a plane (LT) defined by the tangential axis (T) and the longitudinal axis (L) of the spatial coordinate system, and wherein the deflection edge (44) is inclined in a rotational direction toward the working tool side (24) of the sleeve element (20).

3. A depth stop device according to claim 1, wherein the acute angle ($\alpha$) amounts to form 30° to 60°.

4. A depth stop device according to claim 1, wherein the acute angle ($\alpha$) amounts to from 40° to 50°.

5. A depth stop device according to claim 1, wherein the intersection plane (SE) intersects a plane (LR) which is defined by the longitudinal (L) and radial (R) axes, along an intersection axis (SLR) that forms with the longitudinal axis (L) an angle ($\beta$) from 30° to 45°.

6. A depth stop device according to claim 1, wherein the exit opening (36) narrows in a direction of the working tool side (24) of the sleeve element (20).

7. A depth stop device according to claim 6, wherein the exit opening (36) is limited in a rotational tangential direction (U) by two straight, radially extending side surfaces (38).

8. A depth stop device according to claim 1, wherein the sleeve element (20) has two, located opposite each other, exit openings (36).

9. A depth stop device according to claim 7, wherein a deflection flute (48) is formed between the deflection surface (40) and one of the two-side surfaces (38).

* * * * *